US012449185B2

(12) United States Patent
Lee et al.

(10) Patent No.: US 12,449,185 B2
(45) Date of Patent: Oct. 21, 2025

(54) REFRIGERATOR

(71) Applicant: LG ELECTRONICS INC., Seoul (KR)

(72) Inventors: Joongkeun Lee, Seoul (KR); Hyunsung Park, Seoul (KR); Jeongyo Ha, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 220 days.

(21) Appl. No.: 18/023,503

(22) PCT Filed: Sep. 2, 2021

(86) PCT No.: PCT/KR2021/011814
§ 371 (c)(1),
(2) Date: Feb. 27, 2023

(87) PCT Pub. No.: WO2022/050702
PCT Pub. Date: Mar. 10, 2022

(65) Prior Publication Data

US 2023/0314063 A1 Oct. 5, 2023

(30) Foreign Application Priority Data

Sep. 2, 2020 (KR) ..... 10-2020-0111742

(51) Int. Cl.
*F25D 23/02* (2006.01)
*F25D 29/00* (2006.01)

(52) U.S. Cl.
CPC ..... *F25D 23/028* (2013.01); *F25D 29/005* (2013.01); *F25D 2500/06* (2013.01); *F25D 2700/06* (2013.01)

(58) Field of Classification Search
CPC .. F25D 23/028; F25D 29/005; F25D 2500/06; F25D 2700/06
See application file for complete search history.

(56) References Cited

U.S. PATENT DOCUMENTS

2014/0320647 A1* 10/2014 Seo ..... F25D 29/00 348/143
2018/0189027 A1* 7/2018 Jeon ..... F25D 23/02

FOREIGN PATENT DOCUMENTS

CN 105338243 2/2016
EP 2784419 10/2014
(Continued)

OTHER PUBLICATIONS

International Search Report dated Dec. 8, 2021 issued in Application No. PCT/KR2021/011814.
(Continued)

*Primary Examiner* — Matthew W Ing
(74) *Attorney, Agent, or Firm* — KED & ASSOCIATES, LLP

(57) ABSTRACT

A refrigerator, according to the present embodiment, comprises: a cabinet having a storage chamber; a storage chamber camera provided in the cabinet to photograph the storage chamber; a first door for opening and closing the storage chamber; a second door spaced apart from the first door in a horizontal direction and including a main door including a door storage unit and a sub-door that opens and closes the door storage unit and is rotatable about a hinge with respect to the main door; a first camera and a second camera which are provided in the sub-door and photograph the door storage unit when the sub-door is opened; a controller to which the second camera is independently connected; and a USB hub which is connected to the controller and to which the first camera and the storage chamber camera are connected.

20 Claims, 12 Drawing Sheets

(56) References Cited

FOREIGN PATENT DOCUMENTS

| | | | | |
|---|---|---|---|---|
| JP | 2018-084408 | | | 5/2018 |
| KR | 20060099985 | A | * | 9/2006 |
| KR | 10-0677269 | | | 2/2007 |
| KR | 10-2014-0120386 | | | 10/2014 |
| KR | 10-2015-0127560 | | | 11/2015 |
| KR | 10-2018-0114025 | | | 10/2018 |
| KR | 10-2024595 | | | 9/2019 |

OTHER PUBLICATIONS

Extended European Search Report dated Sep. 20, 2024 issued in Application No. 21864661.0.

* cited by examiner

REFRIGERATOR

CROSS-REFERENCE TO RELATED PATENT APPLICATIONS

This application is a U.S. National Stage Application under 35 U.S.C. § 371 of PCT Application No. PCT/KR2021/011814, filed Sep. 2, 2021, which claims priority to Korean Patent Application No. 10-2020-0111742, filed Sep. 2, 2020, whose entire disclosures are hereby incorporated by reference.

TECHNICAL FIELD

The present disclosure relates to a refrigerator.

BACKGROUND ART

In general, a refrigerator is a home appliance that allows food to be stored at a low temperature in an internal storage space shielded by a door. To this end, the refrigerator is configured to cool the inside of the storage space using cold air generated through heat exchange with a refrigerant circulating in a refrigerating cycle, thereby storing food in an optimal state.

Recently, refrigerators are gradually becoming larger and more multi-functional in accordance with the trend of changing dietary habits and upgrading products, and refrigerators equipped with various structures and convenience devices capable of improving user convenience and efficiently using an internal space are being released.

The storage space of the refrigerator may be opened and closed by a door. Depending on the arrangement of the storage space and the structure of the door that opens and closes the storage space, the refrigerators may be classified into various types of refrigerators.

A separate storage space accessible from the outside may be provided in the door of the refrigerator. Through such a storage space, it is possible to access the storage space by opening some auxiliary doors or home bar doors without opening the entire refrigerator door.

Accordingly, frequently used foods may be stored in the separate storage space provided in the refrigerator door. Since the entire refrigerator door is not opened to store food, there is an advantage in minimizing leakage of cool air inside the refrigerator to the outside.

However, even in this structure, there is fundamentally a problem in that the food inside cannot be checked unless the refrigerator door is opened. That is, the door shall be opened to check whether desired food is stored in the space inside the refrigerator or in the separate storage space provided in the door.

If there is no desired food when opening the auxiliary door or the home bar door, there is an inconvenience such as having to open the main door again, and at this time, there is a problem in that unnecessary leakage of cold air may occur.

In order to solve this problem, a part of a front surface of the refrigerator door may be formed of a transparent material, but in this case, an insulation problem may occur in the refrigerator. In addition, when the inside of the refrigerator may be seen through even when the refrigerator is not in use, food is exposed to the outside as it is, resulting in a very poor appearance.

Meanwhile, Korean Laid-Open Patent Publication No. 10-2015-0127560 (publication date: Nov. 17, 2015), which is a prior document, provides a refrigerator capable of providing information about food stored in a refrigerator even if a user does not open a door.

The refrigerator may include a cabinet having an opening formed in a front surface to allow a user to take in and take out food; a door rotatably mounted on the cabinet to open and close the opening; a storage space accommodated in the cabinet, partitioned between the door and the cabinet, and forming an independent cold air holding space for storing food therein; and a camera installed inside the storage space to obtain an image by photographing the food stored in the storage space.

According to prior document, a technology of displaying an image photographed by the camera on the door after the door is opened is disclosed.

However, in the case of the prior document, since the camera photographs the inside of the storage space, there is still a disadvantage in that the user cannot check the food stored in the door.

INVENTION

Technical Problem

The present embodiment provides a refrigerator capable of checking food stored in a storage space and food stored in a refrigerator door in a state in the refrigerator door is closed.

Optionally or additionally, the present embodiment provides a refrigerator capable of presenting an optimal image to a user by correcting an installation tolerance when a camera is installed.

Optionally or additionally, the present embodiment provides a refrigerator for preventing an error occurring when a plurality of cameras operates simultaneously.

Optionally or additionally, the present embodiment provides a refrigerator capable of showing an optimal image to a user without increasing the size of a memory when a plurality of cameras is used.

Technical Solution

A refrigerator according to an aspect may comprise a cabinet including a storage space, a storage space camera provided in the cabinet and configured to photograph the storage space, one or more doors configured to open and close the storage space, and first and second cameras provided in the one or more doors.

The one or more doors may include a first door and a second door spaced apart in a horizontal direction.

The first door and/or the second door may include a main door comprising a door storage and a sub door configured to open and close the door storage and rotatable about a hinge with respect to the main door. The first camera and the second camera may photograph the door storage.

The second camera may be independently connected to a controller.

A USB hub may be connected to the controller. The first camera and the storage space camera may be connected to the USB hub.

The first camera and the second camera may be spaced apart in the sub door in a an upper-and-lower direction.

A memory configured to store an image photographed by each of the cameras may be further included.

The memory may include a first memory configured to store an image photographed by the storage space camera, a second memory configured to store an image photographed by the first camera, and a third memory configured to store an image photographed by the second camera.

Images photographed by the cameras may be stored in the respective memories in chronological order.

In a state in which the first door and the second door are opened, the storage space camera may be activated and the first and second cameras may be deactivated regardless of opening and closing of the sub door.

In a state in which the first door is closed and the second door is opened, the storage space camera may be activated and the first and second cameras may be deactivated regardless of opening and closing of the sub door.

In a state in which the second door is closed and the first door is opened, the storage space camera may be activated, the first camera may be deactivated regardless of opening and closing of the sub door, and the second camera may be activated when the sub door is opened.

An image photographed by the activated second camera may be stored in the third memory.

The storage space camera may be deactivated when the first and second door are closed, and the first and second cameras may be activated when the sub door is opened.

The sub door may further comprise a display configured to display a resultant image obtained from an image photographed by each of the cameras.

A resultant image may be obtained from an image photographed by the storage space camera when one or more of the first door and the second door are opened and then closed, and the obtained resultant image may be displayed on the display.

The storage space camera may photograph the storage space when one or more of the first door and the second door are opened at an opening reference angle or more and then closed.

The storage space includes a slidable drawer and having a storage therein. In a state in which one or more of the first door and the second door are opened, the drawer is opened and then closed and then the opened door is closed after the drawer is closed, a resultant image may be obtained from an image photographed by the storage space camera and the obtained resultant image may be displayed on the display. The resultant image may include an image part having the storage inside the drawer photographed by the storage space camera at a specific point where the drawer is opened.

A resultant image may be obtained from an image photographed by an activated camera of the first and second cameras when the sub door is opened and then closed, and the obtained resultant image may be displayed on the display.

When the first and second cameras are activated to photograph the door storage, a first image photographed by the first camera may be selected from a memory, and a second image photographed by the second camera may be selected from a memory. The controller may display, on the display, a resultant image including a first image part extracted from the selected first image and a second image part extracted from the selected second image.

When the first camera is deactivated and the second camera is activated to photograph the door storage, a second image photographed by the second camera may be selected from a memory, and a first image part included in a past resultant image may be extracted from a memory.

The controller displays, on the display, a resultant image including a first image part extracted from the past resultant image and a second image part extracted from the selected second image.

A memory configured to store an initial image for correcting an image photographed by each of the cameras may be further included.

The controller may compare an image photographed by each of the cameras with the initial image, perform coordinate correction and store the photographed image in a memory.

A memory configured to store an initial image for correcting an image photographed by each of the cameras may be further included.

The controller may compare an image used to generate a resultant image among images photographed by the cameras with the initial image and perform coordinate correction.

A refrigerator another aspect may comprise a cabinet including a storage space, a storage space camera provided in the cabinet and configured to photograph the storage space, a main door configured to open and close the door storage and including a door storage, a sub door configured to open and close the door storage and rotatable about a hinge with respect to the main door, first and second cameras provided in the sub door and configured to photograph the door storage in a state in which the sub door is opened, a controller independently connected with the second camera, and a USB hub connected to the controller and connected with the first camera and the storage space camera. The storage space may be a refrigerating space.

A refrigerator according to another aspect comprises a cabinet including a storage space, a storage space camera provided in the cabinet and configured to photograph the storage space, a first door configured to open and close the storage space, a second door spaced apart from the first door in a horizontal direction and including a main door including a door storage and a sub door configured to open and close the door storage and rotatable about a hinge with respect to the main door, first and second cameras provided in the sub door and configured to photograph the door storage in a state in which the sub door is opened, a controller independently connected with the second camera, and a USB hub connected to the controller and connected with the first camera and the storage space camera.

Effect of the Invention

According to the present embodiment, it is possible to check food stored in a storage space and food stored in a refrigerator door in a state in the refrigerator door is closed.

According to the present embodiment, it is possible to present an optimal image to a user by correcting an installation tolerance when a camera is installed.

According to the present embodiment, it is possible to prevent an error occurring when a plurality of cameras operates simultaneously.

According to the present embodiment, it is possible to show an optimal image to a user without increasing the size of a memory when a plurality of cameras is used.

BEST MODE

Figure 1:
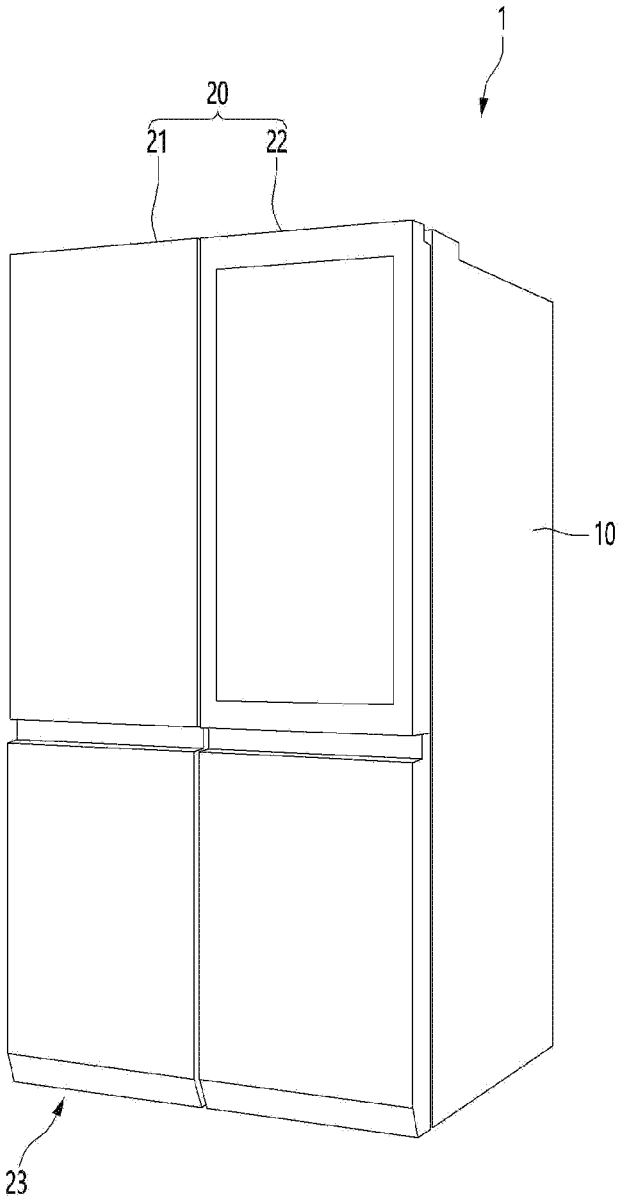
FIG. 1 is a perspective view of a refrigerator according to the present embodiment.

Hereinafter, some embodiments of the present disclosure will be described in detail with reference to the accompanying drawings. It should be noted that when components in the drawings are designated by reference numerals, the same components have the same reference numerals as far as possible even though the components are illustrated in different drawings. Further, in description of embodiments of the present disclosure, when it is determined that detailed descriptions of well-known configurations or functions disturb understanding of the embodiments of the present disclosure, the detailed descriptions will be omitted.

Also, in the description of the embodiments of the present disclosure, the terms such as first, second, A, B, (a) and (b) may be used. Each of the terms is merely used to distinguish the corresponding component from other components, and does not delimit an essence, an order or a sequence of the corresponding component. It should be understood that when one component is "connected", "coupled" or "joined" to another component, the former may be directly connected or jointed to the latter or may be "connected", coupled" or "joined" to the latter with a third component interposed therebetween.

Figure 2:
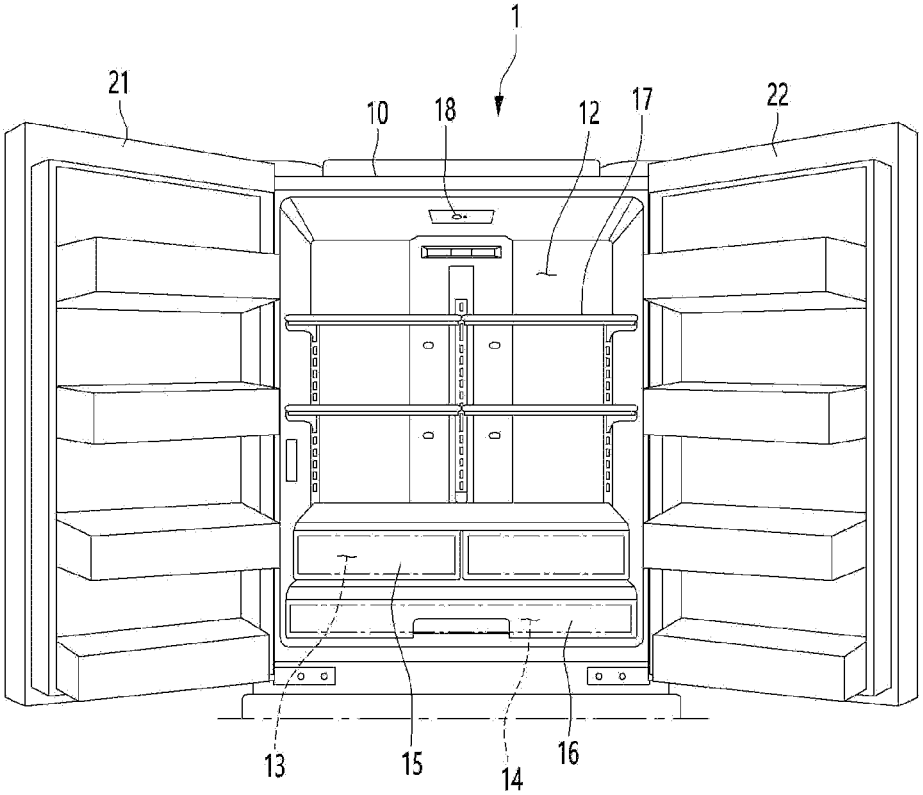
FIG. 2 is a view showing a state in which a refrigerating space door of the present embodiment is opened.
Figure 3:
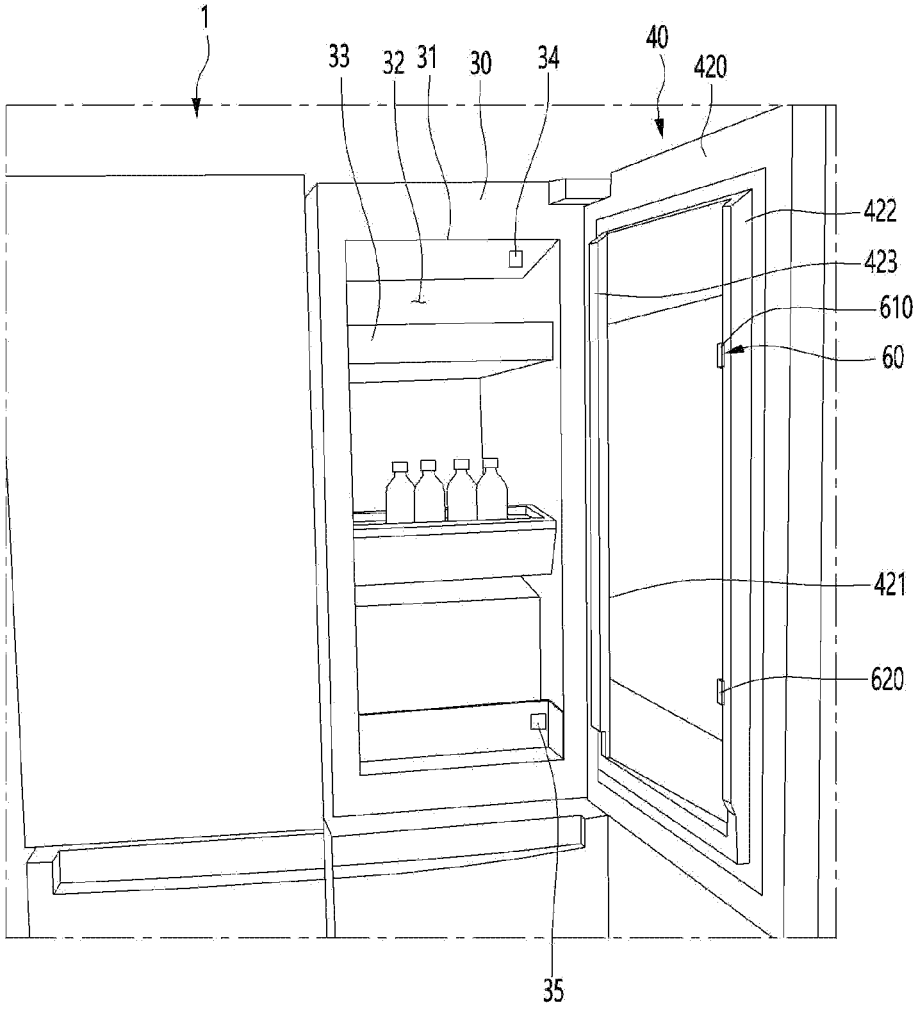
FIG. 3 is a view showing a state in which a sub door of the present embodiment is opened.
Figure 4:
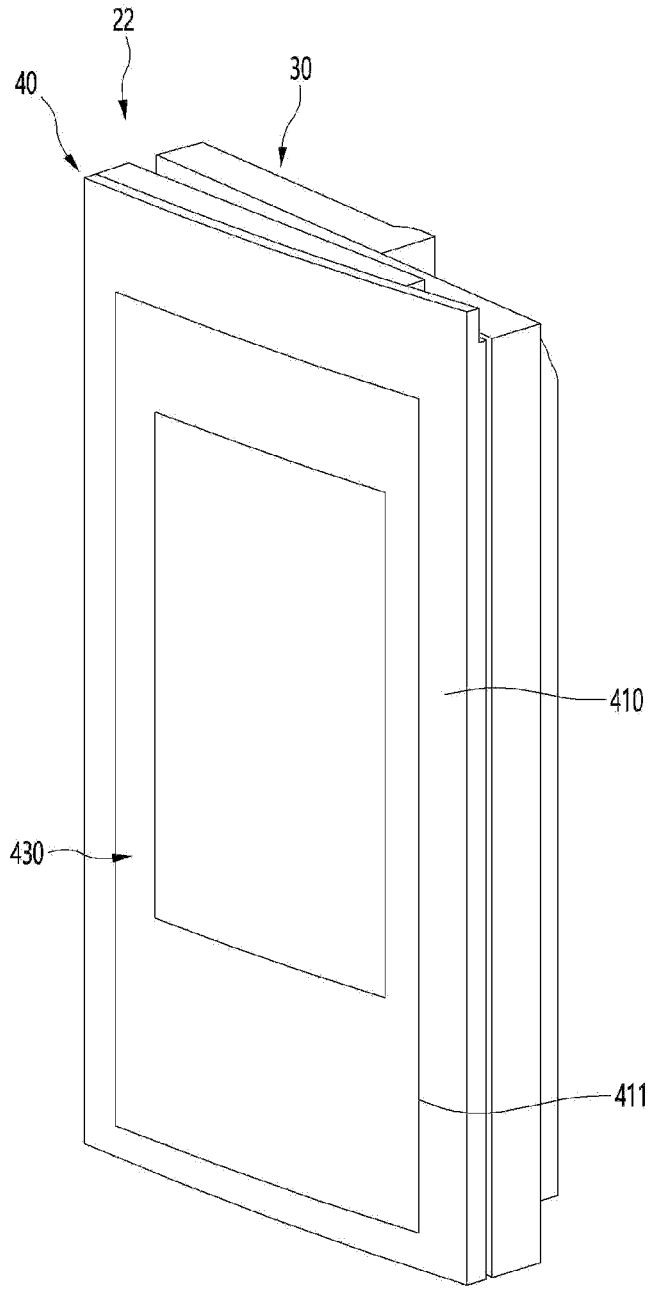
FIG. 4 is a perspective view of a refrigerating space door of the present embodiment.

FIG. 1 is a perspective view of a refrigerator according to the present embodiment, and FIG. 2 is a view showing a state in which a refrigerating space door of the present embodiment is opened. FIG. 3 is a view showing a state in which a sub door of the present embodiment is opened, and FIG. 4 is a perspective view of the refrigerating space door of the present embodiment.

Referring to FIGS. 1 to 4, the refrigerator 1 of the present embodiment may include a cabinet 10 having a storage space and refrigerator doors 20 and 23 opening and closing the storage space.

The storage space may include, for example, a refrigerating space 12. The refrigerating space 12 may be opened and closed by the refrigerating space door 20.

When the storage space additionally includes a freezer space, the freezer space may be opened and closed by the freezer space door 23. FIG. 1 shows the refrigerator 1 including the refrigerating space 12 and a freezer space as an example.

The refrigerating space 12 may be located above or below the freezer space, or may be located on the left or right side of the freezer space.

The refrigerating space door 20 may include a first refrigerating space door 21 and a second refrigerating space door 22 disposed from side to side. Each of the first and second refrigerating space doors 21 and 22 may be rotatably connected to the cabinet 10 by a hinge.

The freezer space door 23 may include a single door or a plurality of independently operated doors. When the freezer space door 23 includes a plurality of doors, at least one of the plurality of doors may be slidably connected to the cabinet 10 or rotatably connected to the cabinet 10 by a hinge.

At least one of the first or second refrigerating space doors 21 or 22 may include a main door 30 and a sub door 40. FIG. 3 shows the second refrigerating space door 22 including a main door 30 and a sub door 40 as an example.

The main door 30 may open and close the refrigerating space 12, and the sub door 40 may rotate with respect to the main door 30. The sub door 40 may be rotatably connected to the main door 30 or the cabinet 10.

The size of a front surface of the sub door 40 may be the same as that of a front surface of the main door 30. In this case, the sub door 40 may be disposed in a form overlapping the main door 30 in a state of being located in front of the main door 30.

Alternatively, the size of the front surface of the sub door 40 may be smaller than that of the front surface of the main door 30. In this case, a space where the sub door 40 is positioned is provided in the front surface of the main door 30, and the sub door 40 may be accommodated in the space. Then, the front surface of the sub door 40 may form a continuous surface with the front surface of the main door 30.

The inside of the refrigerating space 12 may be divided into a plurality of spaces by one or more shelves 17. The refrigerating space 12 may include one or more divided separate storages 13 and 14.

The storages 13 and 14 may include, for example, a vegetable compartment for storing vegetables. The vegetable compartment may be an internal space of a substantially slidable drawer 15. For example, two drawers 15 may be independently slidably arranged from side to side.

The storages 13 and 14 may include a multi-accommodation compartment. The multi-accommodation compartment is a space inside a separate basket 16 and may be opened and closed by a separate slidable storage space cover.

In order to check the inside of the storages 13 and 14, a user shall open the refrigerating space door 20 and then open the drawer 15 or open the cover again, which may cause cumbersomeness to users.

Accordingly, the refrigerator 1 may further include a storage space camera (or third camera) 18 for photographing the refrigerating space 12. The storage space camera 18 may photograph at least the storages 13 and 14. A resultant image obtained from an image photographed by the storage space camera 18 may be displayed through a display 440 provided in the refrigerating space door 20 in a state in which the refrigerating space door 20 is closed.

The storages 13 and 14 may be located at a lower side within the refrigerating space 12. In this case, the storage space camera 18 may be located close to a front end of an upper wall of the refrigerating space 12.

In a state in which the drawer 15 is open, the storage space camera 18 may look at the storages 13 and 14, so that the storages 13 and 14 may be photographed by the storage space camera 18.

For example, a discharge unit for discharging cold air toward the refrigerating space door 20 may be provided in an upper wall of the refrigerating space 12, and the storage space camera 18 may be located behind the discharge unit.

Figure 6:
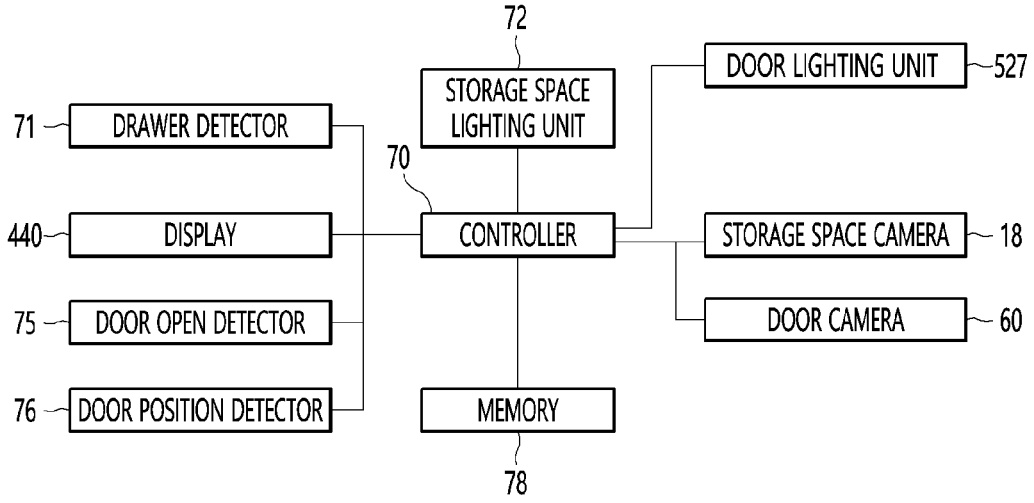
FIG. 6 is a block diagram of a refrigerator according to the present embodiment.

The refrigerator 1 may further include a storage space lighting unit (see 72 in FIG. 6). The storage space lighting unit may be located behind the storage space camera 18. That is, the storage space camera 18 may be disposed between the discharge unit and the storage space lighting unit. The operation of the storage space camera 18 will be described later.

Meanwhile, referring to FIG. 3, the main door 30 may include an opening 31. In addition, the main door 30 may include a door storage 32. The door storage 32 may include a door basket 33 fixed to or detachably connected to the main door 30. In addition, the door storage 32 may include a space between a plurality of door baskets 33.

The opening 31 may be covered by the sub door 40. In a state in which the sub door 40 is open, the user may access the door storage 32 through the opening 31.

The sub door 40 may include an outer plate 410 and a door liner 420.

The outer plate 410 may form a front surface of the sub door 40. The outer plate 410 may be formed of, for example, a metal material. The outer plate 410 may include a first opening 411.

The door liner 420 may include a second opening 421. The second opening 421 may be disposed to face the first opening 412.

The sub door 40 may further include a panel assembly 430.

The panel assembly 430 may be disposed to cover the first opening 411 and the second opening 421. Light may pass through the panel assembly 430. The door storage 32 is visible from the outside by the panel assembly 430.

The door liner 420 may include a pair of door dikes 422 and 423. The pair of door dikes 422 and 423 are parts of the door liner 420 protruding toward the cabinet 10, and may be located in the opening 31 of the main door 30 in a state in which the sub door 40 is closed. The door dikes 422 and 423 may serve to block leakage of cold air from the refrigerating space 12.

The pair of door dikes 422 and 423 may include a first dike 422 and a second dike 423 spaced apart in a horizontal direction. Each of the dikes 422 and 423 may be formed long in an upper-and-lower direction.

During the rotation of the sub door 40, the radius of rotation of the first dike 422 around the hinge is greater than that of the second dike 423.

The first dike 422 may be positioned closer to a door adjacent in a horizontal direction than the second dike 423. In the present embodiment, the first dike 422 may be located closer to the first refrigerating space door 21 than the second dike 423.

A door camera 60 may be provided on at least one of the door liner 420 or the panel assembly 430. FIG. 3 shows the door camera 60 positioned on the door liner 420 as an example.

The door camera 60 may photograph the door storage 32. The upper-and-lower length of the door storage 32 may be longer than the left-and-right length thereof. Accordingly, the door camera 60 may include two or more cameras so that the door camera 60 may photograph the entire area of the door storage 32.

For example, the door camera 60 may include a first camera 610 and a second camera 620. The first and second cameras 610 and 620 may be spaced apart from each other in an upper-and-lower direction and disposed on the door liner 420.

The second camera 620 may be located below the first camera 610.

The first and second cameras 610 and 620 may be provided in the first dike 422. Based on a bisector that bisects the height of the first dike 422, the first camera 610 may be positioned higher than the bisector, and the second camera 620 may be positioned lower than the bisector.

One or more markers 34 and 35 may be provided on the main door 30. For example, the main door 30 may include a first marker 34 and a second marker 35 positioned lower than the first marker 34.

The first and second markers 34 and 35 may be located inside the opening 31 or outside the opening 31. When the first and second markers 34 and 35 are disposed outside the opening 31, the first marker 34 is disposed adjacent to an upper end of the opening 31, and the second marker 35 may be disposed adjacent to a lower end of the opening 31.

In a state in which the sub door 40 is open, an image photographed by the first camera 610 may include the first marker 34 and an image photographed by the second camera 620 may include the second marker 34.

Figure 5:
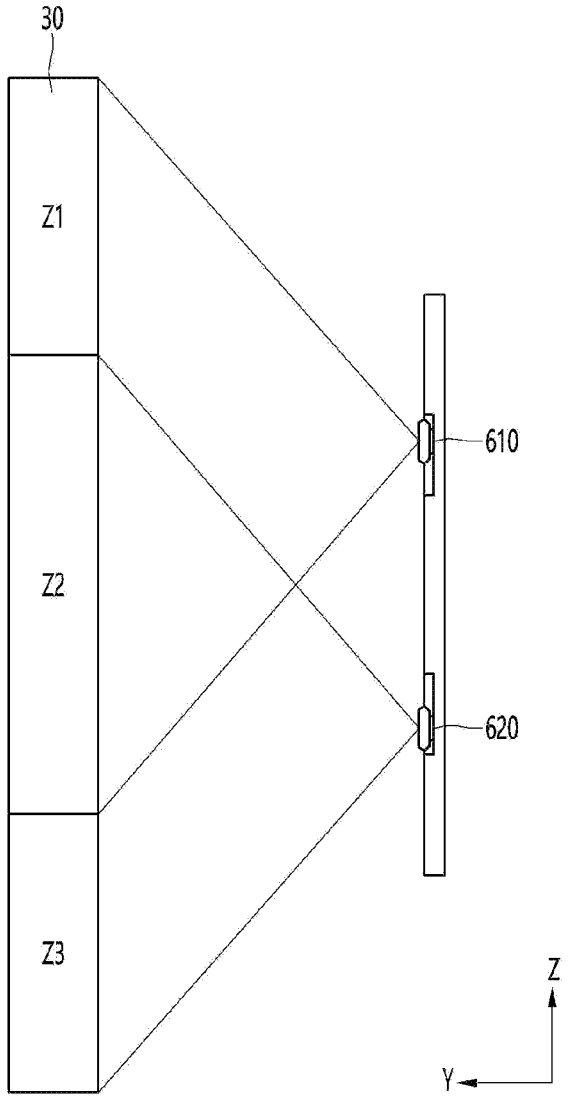
FIG. 5 is a diagram showing an area photographed by a first camera and a second camera according to the present embodiment.

FIG. 5 is a diagram showing an area photographed by a first camera and a second camera according to the present embodiment.

Referring to FIG. 5, in a state in which the sub door 40 is open, the first camera 610 photographs an upper portion and central portion of the main door 30, and the second camera 620 photographs the central portion and lower portion of the main door 30.

The main door 30 may be divided into first to third areas Z1, Z2, and Z3 in the upper-and-lower direction.

The first area Z1 is an area photographed only by the first camera 610. The first marker 34 may be located in the first area Z1.

The second area Z2 is an area located below the first area Z1, and is an area commonly photographed by the cameras 610 and 620.

The third area Z3 is an area located below the second area Z2 and is photographed only by the second camera 620. The second marker 35 may be located in the third area Z3. In this embodiment, the size of the area is illustrative and is not limited to the area shown in the drawings.

An image photographed by the first camera 610 includes the first area Z1 and the second area Z2, and an image photographed by the second camera 620 includes the second area Z2 and the third region Z3.

One image including the first to third areas Z1 to Z3 may be obtained by overlapping the second area Z2 in the two images acquired by the cameras 610 and 620.

As another example, a first image part may be generated by extracting at least a part of the first area Z1 and a part of the second area Z2 from the image acquired by the first camera 610, and a second image part may be generated by extracting another part of the second area Z2 and at least a part of the third area Z3 from the image acquired by the second camera 620. Then, it is also possible to obtain one resultant image by synthesizing the first image part and the second image part.

Figure 7:
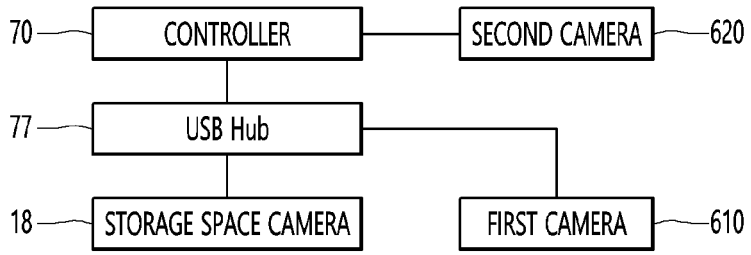
FIG. 7 is a block diagram showing a state in which a plurality of cameras is connected to a controller.
Figure 8:
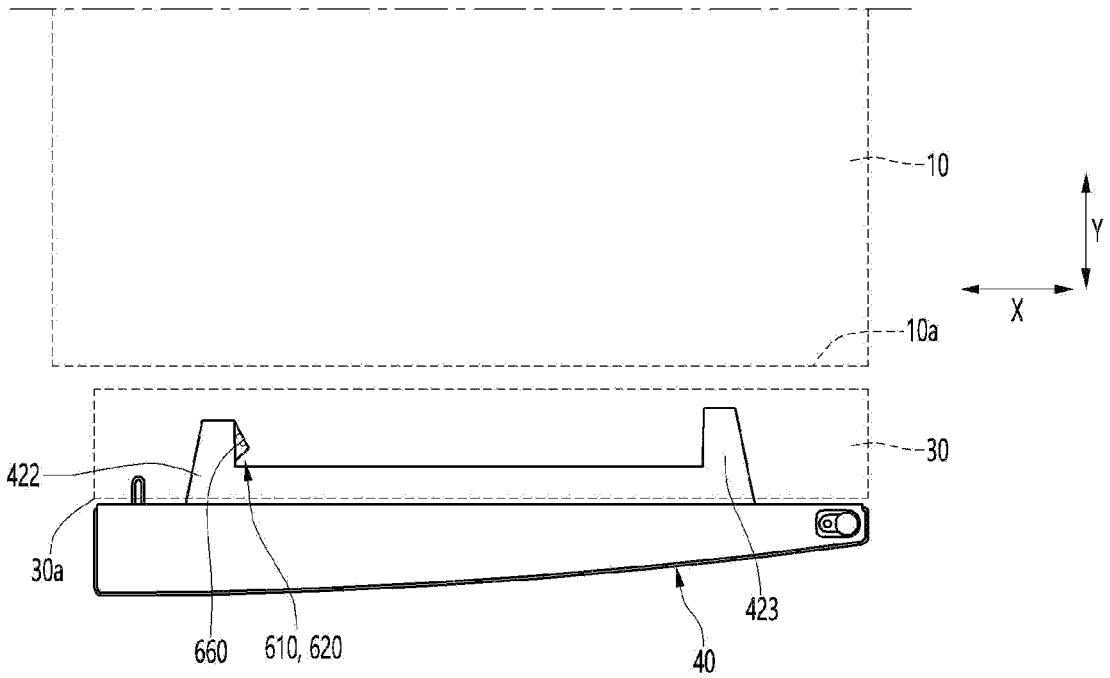
FIG. 8 is a view showing a state in which a main door and a sub door are closed.
Figure 9:
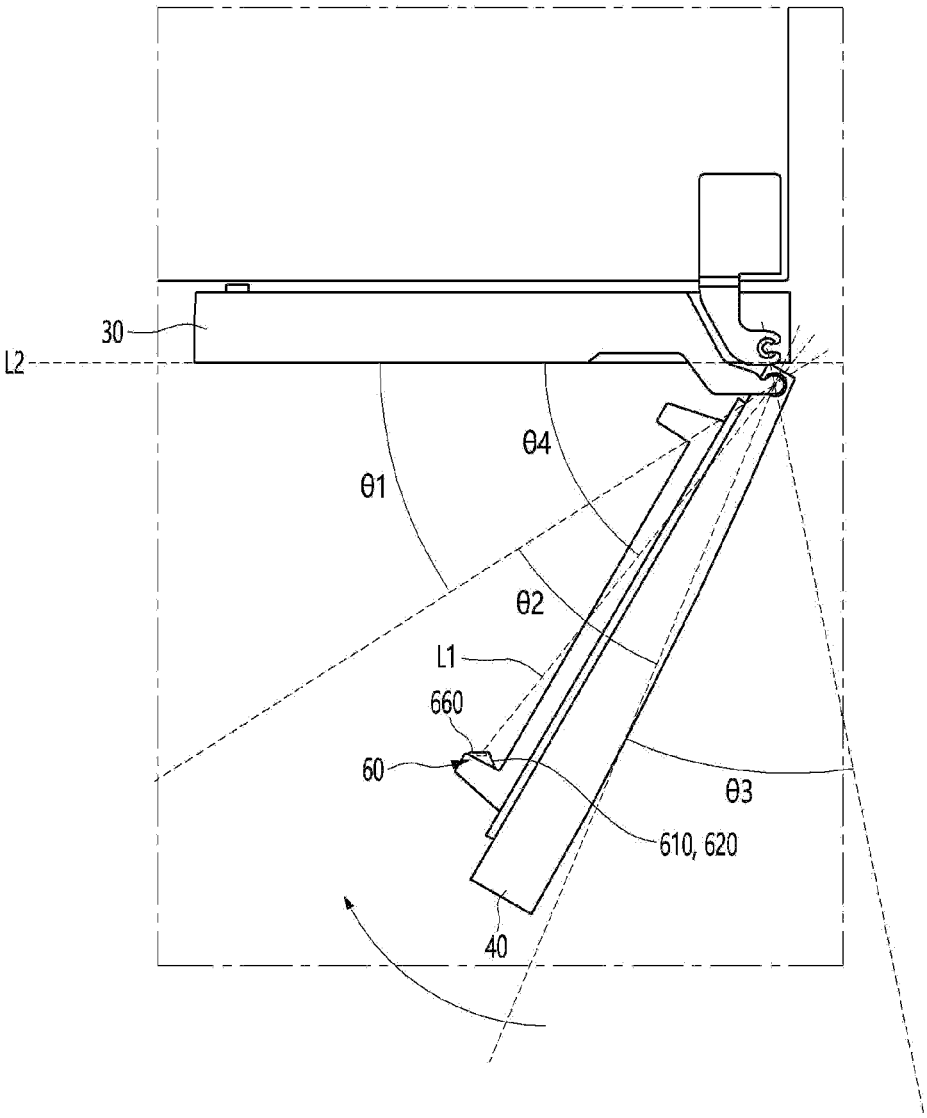
FIG. 9 is a view showing a state in which the sub door is closed after being opened at a maximum opening angle.

FIG. 6 is a block diagram of a refrigerator according to the present embodiment, and FIG. 7 is a block diagram showing a state in which a plurality of cameras is connected to a controller. FIG. 8 is a view showing a state in which a main door and a sub door are closed, and FIG. 9 is a view showing a state in which the sub door is closed after being opened at a maximum opening angle.

Referring to FIGS. 6 to 9, the refrigerator 1 according to the present embodiment may include a controller 70. The controller 70 may control the overall operation of the refrigerator 1, control the operation of some of the components constituting the refrigerator 1, or control some functions included in the refrigerator 1.

The refrigerator 1 may further include a memory 78. Images photographed by the storage space camera 18 and the door camera 60 may be stored in the memory 78.

The refrigerator 1 may further include a display 440. The display 440 may be provided on the sub door 40. For example, the display 440 may be provided on the panel assembly 430 of the sub door 40. For example, the display 440 may further include a touch panel for touch input and an LCD panel for outputting a screen.

The display 440 may display a resultant image obtained from an image photographed by the storage space camera 18.

When receiving a first operation command, the controller 70 may operate the display 440. The display 440 may operate, for example, in a state where the main door 30 and the sub door 40 are closed.

The refrigerator 1 may further include a storage space lighting unit 72. The storage space lighting unit 72 may be turned on, for example, when the refrigerator doors 20 and 23 are opened.

The refrigerator 1 may further include a door open detector 75 for detecting opening of the refrigerating space door 20.

The storage space camera 18 may operate when the refrigerating space door 20 is opened and the storage space lighting unit 72 is turned on.

The refrigerator 1 may further include a door position detector 76 for detecting an open position of the refrigerating space door 20. The door position detector 76 may include, for example, an acceleration sensor. The controller may check a rotation direction of the refrigerating space door 20 and positional information (opening angle) of the refrigerating space door 20 based on information output from the acceleration sensor.

Alternatively, the door position detector 76 may include an optical sensor. The optical sensor may be positioned around a hinge of the refrigerating space door 20, for example. The optical sensor may include a light emitting unit and a light receiving unit. Intensity of light received by the light receiving unit may vary during the process of opening the refrigerating space door.

A signal output from the light receiving unit may vary according to the intensity of light received by the light receiving unit.

The controller 70 may check the rotation direction and rotation angle of the refrigerating space door 20 based on the variable pattern of the signal output from the light receiving unit.

The controller 70 may control the storage space camera 18 to photograph the refrigerating space 12 when the refrigerating space door 20 reaches a photographing reference angle in the case where the refrigerating space door 20 is closed after the refrigerating space door 20 is opened at an opening reference angle or more.

As described above, the image photographed by the storage space camera 18 may include at least a portion of the shelf 17 and at least a portion of the multi-accommodation compartment. A resultant image (current resultant image) obtained from the photographed image may be displayed on the display 440.

Although not limited, the opening reference angle may be greater than or equal to 90 degrees. Also, the photographing reference angle may be 45 degrees.

Accordingly, when the refrigerating space door 20 is closed after the refrigerating space door 20 is opened at less than the opening reference angle, the storage space camera 18 may not operate.

In this case, since the storage space camera 18 did not photograph the refrigerating space 12, a past resultant image stored in the memory 78 may be displayed on the display 440 instead of a current resultant image.

Since the refrigerating space door 20 includes the first refrigerating space door 21 and the second refrigerating space door 22, the door open detector 76 may detect the positions of the first refrigerating space door 21 and the first refrigerating space door 21.

When the second refrigerating space door 22 is closed after the second refrigerating space door 22 is opened at the opening reference angle or more in a state in which the first refrigerating space door 21 is closed, the storage space camera 18 photographs the refrigerating space 12.

When the first refrigerating space door 21 is opened at the opening reference angle or more in a state in which the second refrigerating space door 22 is closed and then and the first refrigerating space door 21 is closed, the storage space camera 18 photographs the refrigerating space 12.

When the first refrigerating space door 21 and the second refrigerating space door 22 are opened simultaneously or sequentially, if each of the refrigerating space doors 21 and 22 is opened at less than the opening reference angle and then closed, the storage space camera 18 doesn't operate.

When the first refrigerating space door 21 and the second refrigerating space door 22 are opened simultaneously or sequentially, if any one of the first refrigerating space door 21 and the second refrigerating space door 22 is opened at the opening reference angle or more, the storage space camera 18 photographs the refrigerating space 12 when one of the doors reaches the photographing reference angle.

When the first refrigerating space door 21 and the second refrigerating space door 22 are opened simultaneously or sequentially, if each of the first refrigerating space door 21 and the second refrigerating space door 22 is opened at the opening reference angle or more, the storage space camera 18 photographs the refrigerating space 12 when the first refrigerating space door 21 reaches the photographing reference angle. In addition, the storage space camera 18 photographs the refrigerating space 12 when the second refrigerating space door 22 reaches the photographing reference angle. In this case, two images are acquired, and the controller 70 may acquire a resultant image from an image obtained later among the two images.

Alternatively, when the first refrigerating space door 21 and the second refrigerating space door 22 are opened simultaneously or sequentially, if each of the first refrigerating space door 21 and the second refrigerating space door 22 is opened at the opening reference angle or more, the storage space camera 18 photographs the refrigerating space 12 when a door closed later among the refrigerating space doors 21 and 22 reaches the photographing reference angle.

The refrigerator 1 may further include a drawer detector 71 for detecting movement of the drawer 15.

When movement of the drawer 15 to a specific position is detected by the drawer detector 71, the storage space camera 18 may photograph the storages 13 and 14.

For example, when the drawer detector 71 detects a withdrawal completion position of the drawer 15, the storage space camera 18 may photograph the storage 13. A photographing surface or lens of the storage space camera 18 may be inclined to face the front side of the cabinet 10 so that the storage space camera 18 may photograph the inside of the drawer 15 at the withdrawal completion position of the drawer 15.

Due to the arrangement of the storage space camera 18, the image photographed by the storage space camera 18 may include at least a portion of the shelf 17 and at least a portion of the multi-accommodation compartment 14.

As another example, a marker may be present in the drawer 15. When the drawer detector 71 detects opening of the drawer 15, the storage space camera 18 photographs the storage 13. The storage space camera 18 takes pictures until the drawer 15 is closed. That is, the storage space camera 18 acquires a plurality of images by photographing the drawer 15 at regular time intervals from opening to closing of the drawer 15.

Photographed images include the marker. The position of the marker in the image may vary according to the position of the drawer 15.

A reference image of the drawer including the marker may be stored in the memory 78. The reference image may be, for example, an image photographed when the drawer 15 is maximally withdrawn.

Among a plurality of photographed images, an image in which the position of the marker is the same as the position of the marker on the reference image may be selected, and a resultant image acquired from the selected image may be displayed on the display 440.

The refrigerator 1 may further include a door lighting unit 527 provided in the refrigerating space door 20. The door lighting unit 527 may be provided in the main door 30 or in the sub door 40.

When receiving a knock-on command applied to the panel assembly 430, the controller 70 may turn on the door lighting unit 527 in a state in which the sub door 40 is closed.

In this case, the user may check the inside of the door storage 32 with the sub door 40 closed. The controller 70 may turn off the door lighting unit 527 when opening of the sub door 40 is detected. At this time, the storage space lighting unit 72 may be turned on.

When opening of the sub door 40 is detected, the first camera 610 and the second camera 620 may operate.

As described above, the display 440 may display resultant images obtained from images photographed by the first and second cameras 610 and 620.

Meanwhile, referring to FIG. 8, the window 660 of the first and second cameras 610 and 620 is disposed to be inclined at a predetermined angle with the front surface 10*a* of the cabinet 10 or the front surface 30*a* of the main door 30 in a state in which the main door 30 and the sub door 40 are closed.

In FIG. 8, an axis parallel to the front surface 30*a* of the main door 30 and extending in a left-and-right horizontal direction may be referred to as an X axis, and an axis perpendicular to the X axis in a horizontal direction may be referred to as a Y axis. An axis perpendicular to the X and Y axes and extending in a upper-and-lower direction may be referred to as a Z axis (see FIG. 5).

In the present embodiment, the window 660 is disposed to be inclined with respect to the X axis and the Y axis in a state in which the main door 30 and the sub door 40 are closed. On the other hand, the window 660 may be parallel to the Z axis.

The controller 70 may operate the door camera 60 when the operating condition of the door camera 60 is satisfied. When the operating condition is satisfied, opening of the sub door 40 is detected.

When opening of the sub door 40 is detected, the first and second cameras 610 and 620 photograph the main door 30 including the door storage 32 at predetermined time intervals.

Images photographed at regular time intervals are stored in the memory 78. At this time, first images (first image group) photographed by the first camera 610 and second images (second image group) photographed by the second camera 610 are separately stored in the memory 78.

The first and second cameras 610 and 620 photograph the main door 30 at regular time intervals until opening and closing of the sub door 40 is detected.

When closing of the sub door 40 is detected, the controller 70 selects one first image from the first image group stored in the memory 78 and selects one second image from the second image group.

Referring to FIG. 9, the sub door 40 may be opened by a maximum opening angle $\theta1+\theta2+\theta3$. During the opening process of the sub door 40, the opening angle of the sub door 40 may be divided into three angle sections $\theta1$, $\theta2$, and $\theta3$. For example, $\theta1$, $\theta2$, and $\theta3$ have the same size.

The selected first image and second image may be images photographed when the sub door 40 is located in the second angle section.

More specifically, when an angle formed by a virtual line L1 connecting the hinge of the sub door 40 and the window 660 and a virtual line L2 passing through the front surface 30*a* of the main door 30 is a reference angle $\theta4$, the window 660 is substantially aligned with the front surface 30*a* of the main door 30.

In a state in which the main door 30 and the sub door 40 are closed, the front surface 30*a* of the main door 30 and the window 660 may be inclined by the reference angle $\theta4$.

The reference angle $\theta4$ may be, for example, greater than or equal to 50 degrees and less than 70 degrees.

Preferably, the reference angle $\theta4$ may be 60 degrees. When the reference angle $\theta4$ is 60 degrees, the window 660 may be located at or close to a bisecting point bisecting the main door 30 from side to side while securing a distance between the window 660 and the front surface 30*a* of the main door 30 and thus the main door 30 may be photographed to be seen best.

The selected first image and second image are images photographed when an angle between the window 660 and the front surface 30*a* of the main door 30 is the reference angle $\theta4$ in a state in which the main door 30 and the sub door 40 are closed.

In addition, the selected first image and second image may be images photographed while the sub door 40 is opened and then closed.

Specifically, the first image may include the first marker 34, and the second image may include the second marker 35.

The position of the first marker 34 may be changed on a plurality of first images photographed according to the position of the sub door 40. In addition, the position of the second marker 35 may be changed on a plurality of second images photographed according to the position of the sub door 40.

A first reference image and a second reference image photographed when the angle between the window 660 and the front surface 30*a* of the main door 30 is the reference angle $\theta4$ may be stored in the memory 78. The first reference image may also include the first marker 34, and the second reference image may also include the second marker 35.

The controller 70 may select a first image, in which the position of the first marker 34 is the same as the position of the first marker 34 of the first reference image, from among the plurality of photographed first images.

In addition, the controller 70 may select a second image, in which the position of the second marker 35 is the same as the position of the second marker 35 of the second reference image, from among the plurality of photographed second images.

At this time, the image stored last among the plurality of first image groups stored in the memory 78 is an image photographed right before the sub door 40 is closed. Accordingly, the controller 70 may sequentially compare the images of the first image group with the first reference image starting from the image photographed last in order to select an image photographed while the sub door 40 is closed. Similarly, the controller 70 may sequentially compare the images of the second image group with the second reference image starting from the image stored last in order to select an image photographed while the sub door 40 is closed.

At this time, among the plurality of photographed first images and second images, only images photographed within a reference time when opening of the sub door 40 is detected may be stored in the memory 78. Accordingly, the number of images stored in the memory 78 may be reduced.

The controller 70 may extract a partial area from the first image and another partial area from the second image to obtain a resultant image obtained by combining the two extracted areas.

Alternatively, the controller 70 may compare the selected first image and second image, extract a common area, and overlap the common area to obtain a new resultant image obtained by synthesizing the two images.

Meanwhile, in order to prevent errors due to simultaneous operation of a plurality of cameras, in the present embodiment, priority is determined according to opening and closing of the first refrigerating space door 21, the second refrigerating space door 22, and the sub door 40.

In addition, in order to prevent an error due to simultaneous operation of a plurality of cameras, priority of operation of some cameras may be determined.

Meanwhile, referring to FIG. 7, a second camera 620 may be independently connected to the controller 70.

A USB hub 77 is connected to the controller 70, and the storage space camera 18 and the first camera 610 may be connected to the USB hub 77.

The controller 70 may include a processor that processes images photographed by the cameras 18 and 60. Substantially, the processor may be connected to each of the cameras 18 and 60.

According to this connection structure, the storage space camera 18 and the first camera 610 cannot operate together. Accordingly, when one of the storage space camera 18 and the first camera 610 is operating (or in an active state), the other may be in an operating standby state (or in an inactive state).

In this specification, the inactive state may mean a state in which photographing is impossible while the camera is in an off state or in an on state.

On the other hand, the storage space camera 18 and the second camera 620 may operate together. Also, the first camera 610 and the second door 620 may operate together.

As another example, the first camera 610 may be independently connected to the controller 70, and the storage space camera 18 and the second camera 620 may be connected to the USB hub 77.

When the second refrigerating space door 22 is opened and the sub door 40 is opened, the second refrigerating space door 22 has higher priority than the sub door 40.

Therefore, according to the connection structure of the controller 70 and the plurality of cameras 18 and 60, as shown in Table 1 below, whether or not the resultant image is updated according to opening of the refrigerating space door 20 and the sub door 40 may be determined.

TABLE 1

| First refrigerating space door | Second refrigerating space door | Sub door | Whether to update image of first image | Whether to update image of second camera |
|---|---|---|---|---|
| open | open | open | X | X |
| open | open | close | X | X |
| close | open | open | X | X |
| close | open | close | X | X |
| open | close | open | X | ○ |
| open | close | close | X | X |
| close | close | open | ○ | ○ |
| close | close | close | X | X |

Referring to Table 1, in a state in which the first refrigerating space door 21 and the second refrigerating space door 22 are opened, the storage space camera 18 is operable and the first camera 610 is inactive. In addition, since the second refrigerating space door 22 has higher priority than the sub door 40, even if the sub door 40 is opened and then closed, the second camera 620 does not take pictures, and accordingly, the resultant image is not updated.

That is, in a state in which the first refrigerating space door 21 and the second refrigerating space door 22 are opened, the first and second cameras 610 and 620 are deactivated regardless of whether the sub door 40 is opened or closed.

Therefore, after opening and closing the sub door 40, the display 440 may display the past resultant image stored in the memory 78 again.

Of course, when the first refrigerating space door 21 and the second freezer space door 22 are closed, the display 440 may display an updated resultant image of the storage space. At this time, the updated resultant image and the past resultant image may be sequentially displayed.

When the second refrigerating space door 22 is opened in a state in which the first refrigerating space door 21 is closed, even if the sub door 40 is opened and then closed, the first and second cameras 610 and 620 does not take pictures, and thus the resultant image is not updated.

Therefore, after opening and closing the sub door 40, the display 440 may display the past resultant image stored in the memory 78 again.

Of course, when the second freezer door 22 is closed, the display 440 may display the updated resultant image of the storage space. At this time, the updated resultant image and the past resultant image may be sequentially displayed.

When the sub door 40 is opened while the second refrigerating space door 22 is closed and the first refrigerating space door 21 is opened, the first camera 610 is deactivated and the second camera 620 is activated. The activated second camera 620 may photograph the door storage 32.

Therefore, after the sub door 40 is closed, a part of the resultant image displayed on the display 440 is a part of the past resultant image stored in the memory 78, and the other part is a part of the resultant image obtained from the second image photographed by the second camera 620. That is, a part of the past resultant image may be displayed on the display 440 in an state of being updated to a new resultant image.

When the sub door 40 is opened and then closed in a state in which the first and second refrigerating space doors 21 and 22 are closed, the first and second cameras 610 and 620 are activated to photograph the door storage 32.

Therefore, after the sub door 40 is closed, the resultant image displayed on the display 440 is a new resultant image in which the entire past resultant image is updated.

In the present embodiment, signal collisions, erroneous display of images on the display, and unnecessary camera operation can be prevented by the connection method of the cameras and the priorities between the cameras.

Figure 10:
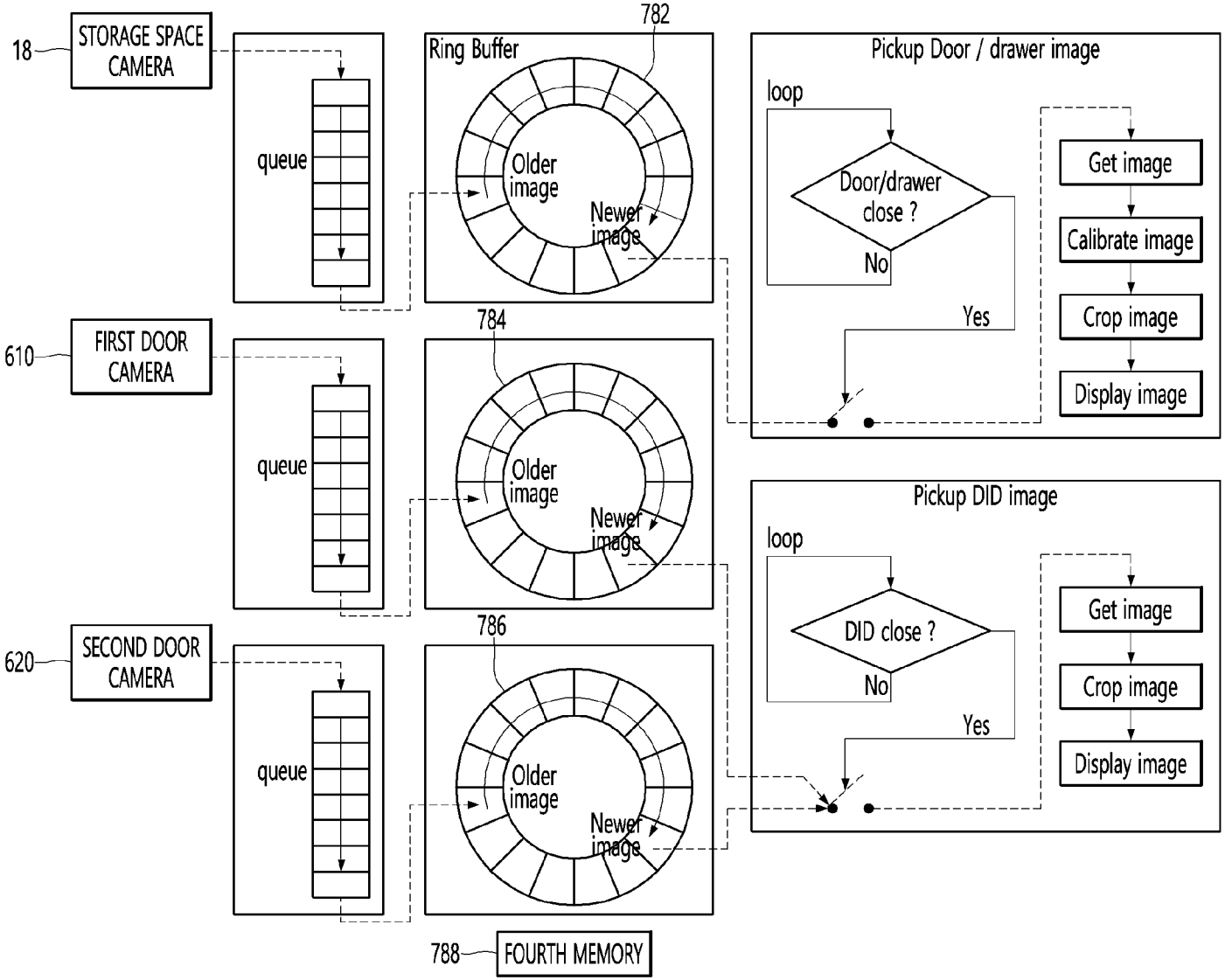
FIG. 10 is a diagram showing a memory structure and an acquisition algorithm of an image stored in the memory.

FIG. 10 is a diagram showing a memory structure and an acquisition algorithm of an image stored in the memory.

Referring to FIG. 10, the memory 78 of the present embodiment includes a first memory 782 in which images photographed by the storage space camera 18 are stored in chronological order, a second memory 784 in which images photographed by the first camera 610 are stored in chronological order, and a third memory 786 in which images photographed by the second camera 620 are stored in chronological order.

The first memory 782 may store an image photographed by the storage space camera 18 for a first reference time after the drawer 15 is opened. If the drawer 15 is opened and the drawer 16 is closed after the first standard time elapses, the image photographed by the storage space camera 18 may not be utilized. In this case, the past resultant image may be displayed on the display 440.

In addition, the second memory 784 and the third memory 786 may store images photographed by the first and second cameras 610 and 620 for a second reference time after the sub door 40 is opened.

When the sub door 40 is opened and the sub door 40 is closed after the second reference time elapses, the images photographed by the first and second cameras 610 and 620 may not be utilized. In this case, the past resultant image may be displayed on the display 440.

The memory 78 may further include a fourth memory 788 for storing the past resultant image. A reference image and an initial image for correction to be described later may be stored in the fourth memory 788.

Accordingly, it is possible to independently select and utilize images photographed by the respective cameras, by the divided first to third memories 782, 784, and 786.

Images are sequentially stored in the memories 782, 784, and 786 for a set reference time. Among the images sequentially stored during the set reference time, the controller 70 may select an image at a specific point in time and obtain a resultant image based on the selected image.

Since images photographed within the set reference time are stored in each of the memories 782, 784, and 786, images at an appropriate point in time to be displayed on the display may be stored without increasing the capacity of the memory.

Figure 11:
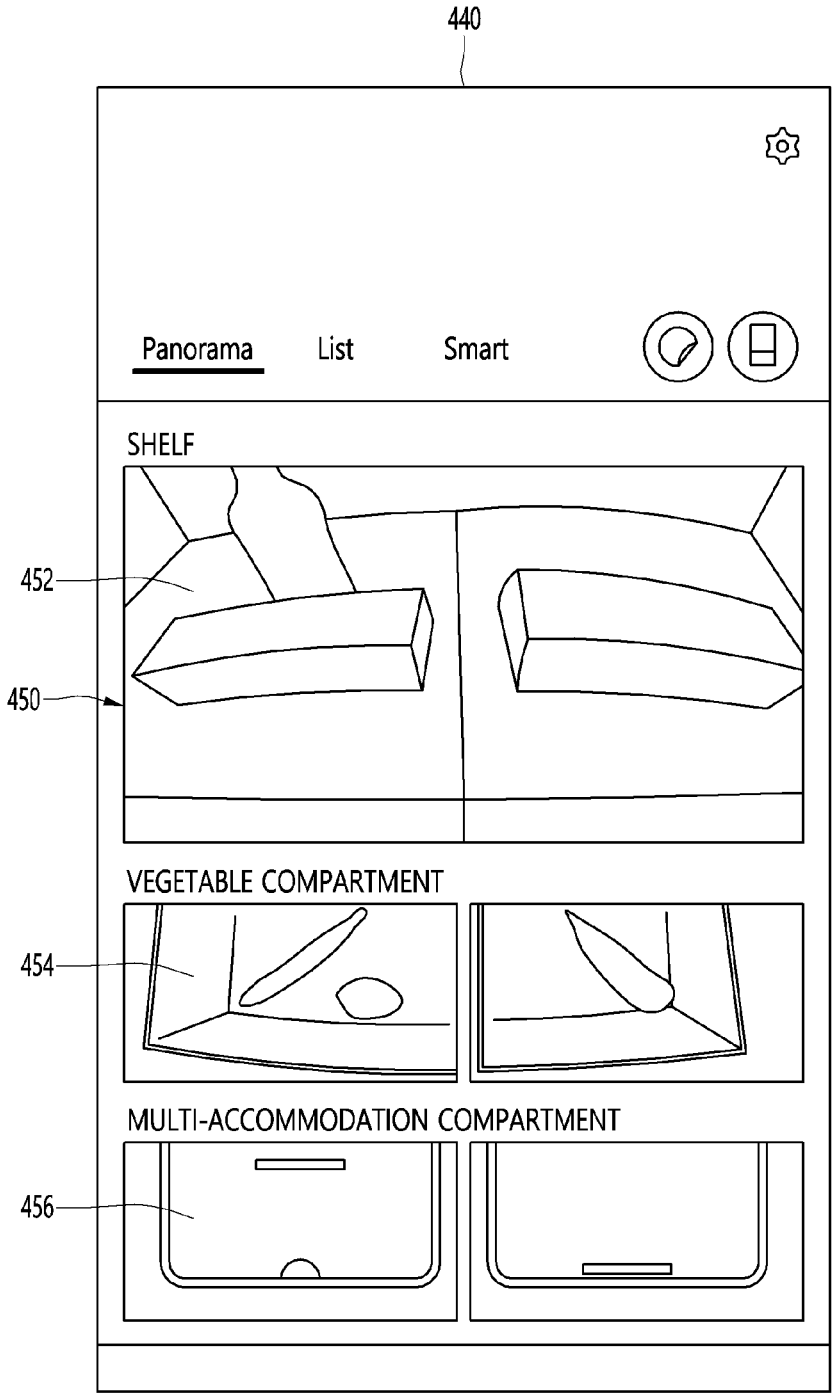
FIG. 11 is a view showing a screen displayed on a display when the refrigerating space door is opened and then closed.
Figure 12:
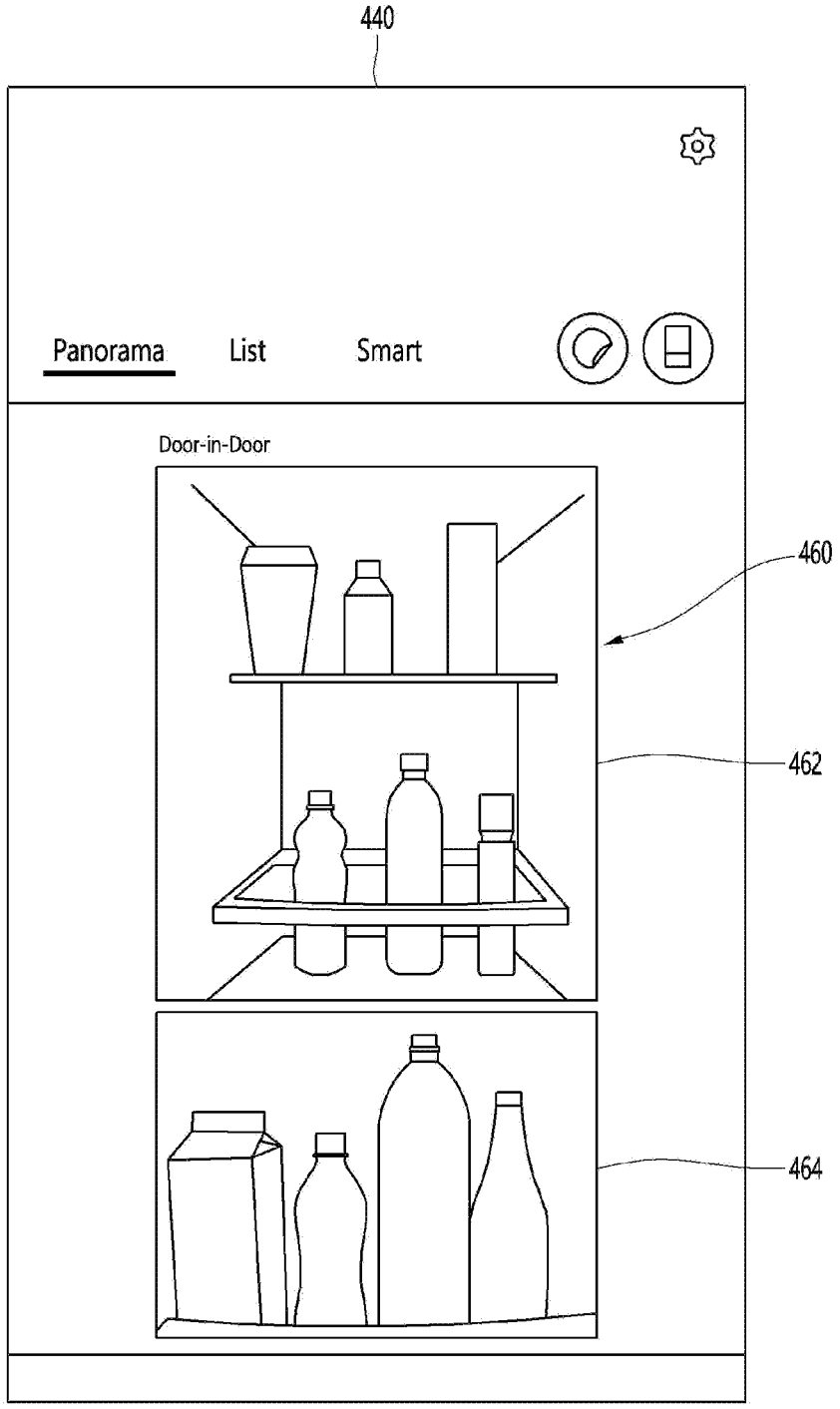
FIG. 12 is a diagram showing a screen displayed on the display when the sub door is opened and then closed.

FIG. 11 is a view showing a screen displayed on the display when the refrigerating space door is opened and then closed, and FIG. 12 is a diagram showing a screen displayed on the display when the sub door is opened and then closed.

Referring to FIGS. 11 and 12, when the refrigerating space door 20 is opened and then closed, the display 440 may display a screen including a first resultant image 450 obtained from an image photographed by the storage space camera 18.

The first resultant image 450 includes a first image part 452 including the shelf 17, a second image part 454 including the drawer 15, and a third image part 456 including the multi-accommodation compartment 14.

The first to third image parts 452, 454, and 456 may be sequentially arranged in an upper-and-lower direction or from side to side.

The first image part 452 and the third image part 456 are images extracted from images of the refrigerating space door 20 photographed at a photographing reference angle.

The controller 70 selects an image photographed by the storage space camera 18 from the first memory 782 when the refrigerating space door 20 reaches a photographing reference angle, and extracts the first image part 45 and the third image part 456 from the selected image.

Also, the controller 70 may select an image photographed before a predetermined time after the drawer 15 is closed. Then, the second image part 454 is extracted from the selected image. When the drawer 15 is not opened until the refrigerating space door 20 is opened and then closed, the controller 70 determines the second image part 454 from the past resultant image stored in the fourth memory 788 or select the past second image part 454 stored in the fourth memory 788.

Finally, the controller 70 may display the first resultant image 450 including the first to third image parts 452, 454 and 456 on the display 440.

When the sub door 40 is opened and then closed while the refrigerating space door 20 is closed, the display 440 may display a screen including a second resultant image obtained from images photographed by the first and second cameras 610 and 620.

Referring to FIG. 12, the second resultant image 460 may include a first image part 462 extracted from the first image photographed by the first camera 610 and a second image part 464 extracted from the second image photographed by the second camera 620.

The controller 70 may select, from the second memory 784, a first image in which the position of the first marker is the same as that of the marker on the reference image. In addition, the controller 70 may select, from the third memory 786, a second image in which the position of the second marker is the same as that of the marker on the reference image.

Then, the first image part 462 and the second image part 464 may be extracted from each of the selected first and second images.

Finally, the controller 70 may display the second resultant image 460 including the first image part 462 and the second image part 464 on the display 440.

Meanwhile, since the first resultant image 450 and the second resultant image 460 are stored in the memory 78, in a state in which the refrigerating space door 20 is closed and the sub door 40 is closed, the first resultant image 450 or the second resultant image 460 may be displayed on the display 440 by input of a display command.

Accordingly, the user may easily check the food stored in the refrigerating space 12 or the door storage 32 without opening the refrigerating space door 20 and the sub door 40.

On the other hand, depending on the installation tolerance when the storage space camera 18 and the door camera 60 are installed, the images photographed by the storage space camera 18 and the door camera 60 may be different from an optimal image.

For example, the drawer is located in the center in the optimal image, whereas the drawer may be located at left or right side of the center in the image photographed by the storage space camera 18.

Therefore, at the beginning of the operation of the refrigerator 1, it is possible to solve deterioration in image quality due to the installation tolerance of the cameras 18 and 60 and to perform a correction algorithm for displaying an optimal image.

At the beginning of operation of the refrigerator 1, each of the cameras 18 and 60 may take a picture at a specific point in time or at a specific angle of the door. The controller 70 compares the images photographed by the cameras 18 and 60 with the initial images stored in the fourth memory 788.

The controller 70 may compare a plurality of reference coordinates of the initial image with a plurality of coordinates of the photographed image, and correct the plurality of coordinates of the photographed image to the plurality of reference coordinates. A coordinate movement distance required for coordinate correction is stored in the fourth memory 788.

Thereafter, the images photographed by the respective cameras 18 and 60 are stored in the memory 78 after coordinate correction, and the corrected images may be used to generate the resultant images 450 and 460.

Alternatively, when the image before correction is stored in the memory 78 and extracted as an image to be used to generate the resultant image, the image corrected by an image correction process may be used to generate the resultant image.

Therefore, in the present embodiment, there is an advantage that an optimal image may be displayed on the display despite the installation tolerance of the camera.

The invention claimed is:

1. A refrigerator comprising:

a cabinet defining a main storage space;

a first door and a second door configured to open and close the main storage space, the second door being spaced apart from the first door in a horizontal direction and including:

a main door defining a door storage space, and a sub door configured to open and close the door storage space and to be rotatable with respect to the main door, and including:

a door liner having an opening, and a panel assembly configured to cover the opening;

first and second cameras provided on the door liner of the sub door and configured to photograph the door storage space;

a third camera provided on the cabinet and configured to photograph the main storage space; and a controller connected via a hub to the first camera and the third camera and connected to the second camera independently of the hub.

2. The refrigerator of claim 1, wherein the first camera and the second camera are spaced apart in the sub door in a vertical direction.

3. The refrigerator of claim 1, further comprising:

a first memory configured to store at least one image photographed by the third camera;

a second memory configured to store at least one image photographed by the first camera; and a third memory configured to store at least one image photographed by the second camera.

4. The refrigerator of claim 3, wherein images are capable of being stored in the first to third memories in chronological order, respectively.

5. The refrigerator of claim 3, wherein, when the first door and the second door are opened, the controller is configured to activate the third camera and to deactivate the first and second cameras regardless of opening and closing of the sub door.

6. The refrigerator of claim 3, wherein, when the first door is closed and the second door is opened, the controller is configured to activate the third camera and to deactivate the first and second cameras regardless of opening and closing of the sub door.

7. The refrigerator of claim 3, wherein, when the second door is closed and the first door is opened, the controller is configured to activate the third camera, to deactivate the first camera regardless of opening and closing of the sub door, and to activate the second camera when the sub door is opened.

8. The refrigerator of claim 3, wherein, when the first door and second door are closed, the controller is configured to deactivate the third camera, and the controller is configured to activate the first and second cameras when the sub door is opened.

9. The refrigerator of claim 1, wherein the sub door further comprises a display configured to display a resultant image obtained from an image photographed by at least one of the first to third cameras.

10. The refrigerator of claim 9, wherein the display is capable of obtaining the resultant image from an image photographed by the third camera when at least one of the first door or the second door is opened and then closed.

11. The refrigerator of claim 10, wherein the third camera is capable of photographing the storage space when the at least one the first door or the second door are opened by at least an opening reference angle and then closed.

12. The refrigerator of claim 9, wherein the storage space includes a slidable drawer having storage therein, wherein, when one or more of the first door or the second door is opened, the drawer is opened and then closed and then the opened one or more of the first door or the second is closed after the drawer is closed, the display is capable of obtaining the resultant image from an image photographed by the third camera while the drawer is opened, wherein at least a portion of the resultant image corresponds the storage inside the drawer.

13. The refrigerator of claim 9, wherein the display is capable of obtaining the resultant image from an image photographed by an activated at least one of the first and second cameras when the sub door is opened and then closed.

14. The refrigerator of claim 13, wherein the controller is capable of activating the first camera when the sub door is opened while the first door and the second door are closed, and wherein the controller is capable of activating the second camera when the sub door is closed in a state in which the second door is closed.

15. The refrigerator of claim 13, wherein, when the first and second cameras are activated to photograph the door storage space, the controller capable of selecting a first image photographed by the first camera and selecting a second image photographed by the second camera, and wherein the resultant image includes a first image region extracted from the selected first image and a second image region extracted from the selected second image.

16. The refrigerator of claim 13, wherein, when the first camera is deactivated and the second camera is activated to photograph the door storage space, the controller is capable of selecting a second image photographed by the second camera and extracting, from a memory, a stored image captured during a prior time period, and wherein the resultant image includes a first image region extracted from the stored image and a second image region extracted from the selected second image.

17. The refrigerator of claim 9, further comprising a memory configured to store an initial image, wherein the controller is capable of comparing an image photographed by one of the first, second, or third cameras with the at least one initial image, performing coordinate correction of the image, and storing a coordinate-corrected image.

18. The refrigerator of claim 9, further comprising a memory configured to store an initial image, wherein the controller is capable of selecting an image used to generate the resultant image from among images photographed by the first, second, or third cameras, comparing the selected image with the stored initial image, and performing coordinate correction of the selected image.

19. A refrigerator comprising:

a cabinet defining a main storage space;

a main door configured to open and close the main storage space and defining a door storage space;

a sub door configured to open and close the door storage space and rotatable with respect to the main door, and including:

a door liner having an opening, and a panel assembly configured to cover the opening;

first and second cameras provided on the door liner of the sub door and configured to photograph the door storage space when the sub door is opened;

a third camera provided on the cabinet and configured to photograph the main storage space; and a controller having a first connection to the first camera and the third camera, and having a second, independent connection to the second camera.

20. A refrigerator comprising:

a cabinet defining a first storage space;

a first door configured to open and close the first storage space and defining a second storage space, a second door configured to open and close the second storage space;

first and second cameras provided to capture images of respective sections of the second storage space;

a third camera provided to capture an image of the first storage space; and a controller having a first connection to the first camera and the third camera, and having a second, independent connection to the second camera, wherein the first camera and the second camera photograph the second storage space when the second door is opened and the first door is closed, and wherein the first and second cameras include respective windows positioned at a predetermine angle relative to a front of the cabinet when first and second doors are closed.

* * * * *